US010604971B2

(12) United States Patent
Pohl et al.

(10) Patent No.: US 10,604,971 B2
(45) Date of Patent: Mar. 31, 2020

(54) DOOR HANDLE SYSTEM FOR A VEHICLE DOOR

(71) Applicant: BROSE FAHRZEUGTEILE GMBH & CO. KOMMANDITGESELLSCHAFT, HALLSTADT, Hallstadt (DE)

(72) Inventors: Florian Pohl, Ebersdorf (DE); Christian Herrmann, Coburg (DE)

(73) Assignee: Brose Fahrzeugteile GmbH & Co. Kommanditgesellschaft, Hallstadt, Hallstadt (DE)

( * ) Notice: Subject to any disclaimer, the term of this patent is extended or adjusted under 35 U.S.C. 154(b) by 787 days.

(21) Appl. No.: 15/006,309

(22) Filed: Jan. 26, 2016

(65) Prior Publication Data

US 2016/0138307 A1 May 19, 2016

Related U.S. Application Data

(63) Continuation of application No. PCT/EP2014/065884, filed on Jul. 24, 2014.

(30) Foreign Application Priority Data

Jul. 26, 2013 (DE) ..... 10 2013 012 489

(51) Int. Cl.
*E05B 81/76* (2014.01)
*E05B 85/10* (2014.01)
(Continued)

(52) U.S. Cl.
CPC ..... *E05B 81/76* (2013.01); *E05B 17/10* (2013.01); *E05B 81/04* (2013.01); *E05B 81/56* (2013.01);
(Continued)

(58) Field of Classification Search
CPC ..... E05B 81/76; E05B 81/04; E05B 81/56; E05B 81/77; E05B 81/78; E05B 85/10; E05B 85/103; E05B 17/10; Y10T 292/57
See application file for complete search history.

(56) References Cited

U.S. PATENT DOCUMENTS 6,062,614 A * 5/2000 Petzold ..... E05B 85/14 292/336.3
7,108,301 B2 9/2006 Louvel
(Continued)

FOREIGN PATENT DOCUMENTS

CN 1961128 A 5/2007
CN 101460691 A 6/2009
(Continued)

OTHER PUBLICATIONS

Computer Generated Translation for DE 102006027473, Generated on Sep. 20, 2018, https://worldwide.espacenet.com/ (Year: 2018).*
(Continued)

*Primary Examiner* — Alyson M Merlino
(74) *Attorney, Agent, or Firm* — Laurence A. Greenberg; Werner H. Stemer; Ralph E. Locher

(57) ABSTRACT

A door handle system for a vehicle door has a door handle and at least one flap for reversibly closing a grip recess set back to the rear of the door handle. An actuating device pivots the one or more flaps between a closed position that covers the handle recess and an open position that exposes the handle recess. A distance sensor is disposed on the flap. A control and evaluation unit uses a first measurement signal that is output by the distance sensor in the closed position, to deduce that a vehicle user is approaching so as to activate the actuation device to move the one or each flap into the open position. A second measurement signal that is output
(Continued)

by the distance sensor in the open position indicates that the door handle is grasped by the vehicle user.

9 Claims, 3 Drawing Sheets

(51) Int. Cl.
*E05B 17/10* (2006.01)
*E05B 81/04* (2014.01)
*E05B 81/56* (2014.01)

(52) U.S. Cl.
CPC ..... *E05B 81/77* (2013.01); *E05B 85/10* (2013.01); *E05B 85/103* (2013.01)

(56) References Cited

U.S. PATENT DOCUMENTS

2004/0177478 A1* 9/2004 Louvel ..... E05B 85/103 16/430
2006/0273088 A1* 12/2006 Burkat ..... E05B 85/107 220/212.5
2008/0021619 A1* 1/2008 Steegmann ..... E05B 81/78 70/276
2008/0067050 A1 3/2008 Ieda et al.
2011/0140479 A1* 6/2011 Okada ..... E05B 81/78 16/412
2013/0170241 A1* 7/2013 Lesueur ..... E05B 85/103 292/336.3
2014/0047877 A1* 2/2014 Bohm ..... E05B 81/77 70/275
2015/0069768 A1* 3/2015 Leve ..... E05B 85/103 292/336.3
2015/0315812 A1* 11/2015 Vasi ..... E05B 85/103 292/336.3

FOREIGN PATENT DOCUMENTS

| | | | | |
|---|---|---|---|---|
| DE | 4217139 | A1 * | 11/1993 | ..... E05B 85/10 |
| DE | 10338767 | A1 | 3/2005 | |
| DE | 102006027473 | A1 * | 12/2007 | ..... E05B 81/76 |
| DE | 102006027473 | A1 | 12/2007 | |
| DE | 102006027474 | A1 | 12/2007 | |
| DE | 102007050094 | A1 | 4/2009 | |
| EP | 1402138 | B1 | 11/2005 | |
| GB | 1120527 | A | 7/1968 | |
| WO | 03004809 | A1 | 1/2003 | |

OTHER PUBLICATIONS

Definition of the word “whether,” https://www.merriam-webster.com/ (Year: 2019).*

* cited by examiner

DOOR HANDLE SYSTEM FOR A VEHICLE DOOR

CROSS-REFERENCE TO RELATED APPLICATION

This application is a continuation, under 35 U.S.C. § 120, of copending international application No. PCT/EP2014/065884, filed Jul. 24, 2014, which designated the United States; this application also claims the priority, under 35 U.S.C. § 119, of German patent application No. 10 2013 012 489.1, filed Jul. 26, 2013; the prior applications are herewith incorporated by reference in their entirety.

BACKGROUND OF THE INVENTION

Field of the Invention

The invention relates to a door handle system for a vehicle door, in particular for a vehicle door that can be moved automatically by way of a door adjusting motor.

In the case of modern (motor) vehicles, in particular passenger motor vehicles, the aim is usually to reduce the consumption of energy and in the case of internal combustion engines that are conventionally used to reduce the consumption of fuel. In addition to improving the drive technology itself (for example internal combustion engines and electric motors), it is frequently desired to decrease the air resistance of the vehicle. For this purpose, in part a vehicle outer surface that is closed as completely as possible and is virtually smooth is styled for the vehicle.

However, in the case of a large proportion of vehicles, in order to open the vehicle doors, door handles are used that are arranged in such a manner that they protrude in a handhold-like manner from the vehicle surface or are arranged above a grip recess that is formed in the vehicle surface. Door handles of this type disrupt both the vehicle surface as well as the aesthetic appearance of the vehicle and in addition offer an increased air resistance—in particular in the case of an additional grip recess being used.

U.S. Pat. No. 7,108,301 B2 and its counterpart European patent application EP 1 402 138 A1 describe covering the grip recess flush with the door handle by means of a flap so that the grip recess is advantageously hidden in an aerodynamic manner. This flap is provided with a sensor by means of which it is possible to detect in the immediate vicinity of the door handle the presence of the hand of the vehicle user who wants to operate the door handle. In the case that the hand is in the proximity of the door handle, the flap is automatically folded into the grip recess and the door handle is consequently revealed.

SUMMARY OF THE INVENTION

It is an object of the invention to provide a door handle which overcomes the above-mentioned and other disadvantages of the heretofore-known devices and methods of this general type and which provides for an improved door handle system for a vehicle.

With the foregoing and other objects in view there is provided, in accordance with the invention, a door handle system for a vehicle door, the door handle system comprising:

a door handle having a rear side;

at least one flap for reversibly closing off a grip recess formed in the vehicle door and set back with respect to an outer surface of the vehicle door relative to the rear side of said door handle;

an adjusting device configured to pivot said at least one flap between a closed position that covers said grip recess and an opened position that reveals said grip recess;

a distance sensor at least in part disposed on said at least one flap or on one of a plurality of said flaps; and a control and evaluating unit configured:

with reference to a first measuring signal output by said distance sensor in the closed position, to conclude that a vehicle user is approaching said at least one flap;

to control said adjusting device so as to adjust said at least one flap into the opened position when detecting that the vehicle user is approaching said at least one flap; and to determine with reference to a second measuring signal output by said distance sensor in the opened position whether said door handle is being gripped by the vehicle user.

In other words, the door handle system in accordance with the invention comprises a door handle and at least one flap for reversibly closing off a grip recess that is set back with respect to the surface of the vehicle door in relation to the rear of the door handle. When the door handle is actuated in the appropriate manner, the hand of the vehicle user regularly grips in this grip recess. Furthermore, the door handle system comprises an adjusting device by means of which it is possible to pivot the one or each flap between a closed position that covers the grip recess and an opened position that reveals the grip recess. In addition, the door handle system comprises a distance sensor (also: proximity sensor) that is arranged at least in part on the flap or on at least one of the flaps. In other words—if the distance sensor comprises multiple parts—at least the part of the distance sensor that is sensitive to proximity is arranged on the flap. Furthermore, the door handle system comprises a control and evaluating unit that is configured so as to conclude with reference to a first measuring signal that is output by the distance sensor in the closed position that the vehicle user is approaching the one or each flap. In addition, the control and evaluating unit is configured so as to control the adjusting device for adjusting the one or each flap into the opened position when the approach is detected. In addition, in accordance with the invention, the control and evaluating unit is configured so as to determine with reference to a second measuring signal that is output in the opened position by the distance sensor whether the door handle has been gripped by the vehicle user, preferably by the hand of the vehicle user. In other words, the control and evaluating unit is configured in a first measuring mode in which the measuring region of the distance sensor, in other words the volume of space that is monitored by means of the distance sensor, is aligned towards the outer side of the vehicle, so as to monitor the surrounding area of the one or each flap for an approach by the vehicle user. In a second measuring mode, the measured region of the same distance sensor is aligned in an opposing direction into the grip recess in order to be able to detect whether the door handle is being gripped by the vehicle user.

This is in particular advantageous for the case that the vehicle door is a vehicle door that can be automatically adjusted by means of a door adjusting motor, said vehicle door preferably being used in conjunction with a so-called keyless entry function (keyless entry/keyless go function). In the case of this function, the vehicle lock that is allocated to the respective vehicle door is by way of example unlocked if the person that is approaching is carrying the (radio) key that is associated with the vehicle. The control and evaluating unit is in particular configured for the purpose of interpreting a gripping of the door handle as being the vehicle user's wish to open the door and consequently to output a door opening command to the door adjusting motor so as to adjust the vehicle door into its open position. As a consequence, it becomes easier to handle the vehicle door and consequently the operating comfort increases.

Advantageously, owing to the fact that the desire to open the door is identified automatically, the door handle can be embodied in such a manner that it does not move with respect to the vehicle door. A conventional unlocking mechanism that is coupled to the door handle for the vehicle door can consequently be omitted.

Moreover, by virtue of using the one or each flap for covering the grip recess, it is advantageously rendered possible to embody the vehicle surface as smooth, in particular from an aerodynamic point of view.

It is preferred that the control and evaluating unit is in addition configured so as in the opened position to detect that the door handle is no longer being gripped and furthermore to adjust the one or each flap back into its closed position. Optionally, the control and evaluating unit is furthermore expediently configured for the purpose of monitoring the grip recess merely for a predetermined time (by way of example 2 to 15 seconds) after opening the one or each flap in order to establish whether the door handle is being gripped. If it is detected in this period that the door handle is not being gripped, the control and evaluating unit is expediently configured so as to control the adjusting device so as to close the one or each flap. As a consequence, it is prevented in a simple manner that in the case of falsely detecting the approach (by way of example if the vehicle user passes the vehicle door in close proximity to the one or each flap) the one or each flap remains in its opened position until further notice.

In a preferred embodiment, the distance sensor is embodied as a capacitive distance sensor. In this case, the one or each flap supports in particular in each case a sensor electrode of the capacitive distance sensor. By way of example, the sensor electrode is integrated into the respective flap. In one embodiment that is expedient in terms of production technology, the flap is embodied for this purpose as a synthetic material injection molded part in which the sensor electrode is injection molded with synthetic material as an electrically conductive insert part.

In an alternative embodiment, the one or each flap itself forms in each case a sensor electrode of the capacitive distance sensor. This is in particular advantageous in the case in which the surface of the flap that is facing towards the outer side of the vehicle is embodied from an electrically conductive, in particular metal, basic material (by way of example sheet metal). This electrically conductive outer layer (in particular an electrically conductive paint layer) of the flap only needs in this case to make contact with the corresponding connection of the distance sensor. Alternatively, however, it is possible within the scope of the invention for the flap to be produced from a sufficiently electrically conductive synthetic material, by way of example injection molded. Embodying the flap as a sensor electrode offers the advantage that on the one hand the installation space that is taken up by the flap and the sensor electrode is particularly small and on the other hand, the entire (outer) surface of the flap can be used for sensing, whereby in turn the range of the distance sensor is increased.

In one embodiment, the one or each flap is pivoted in the opened position against the wall of the grip recess. The flap lies by way of example flush in the wall of the grip recess in or on said grip recess.

In an alternative embodiment, in the opened position the one or each flap is pivoted onto the rear side of the door handle. In this case, the hand of the vehicle user lies directly on the one or each flap when gripping the door handle so that the distance with respect to the sensitive part of the distance sensor, preferably in other words with respect to the capacitive sensor electrode, is minimal. In the case of the capacitive distance sensor, the sensor capacitance of the sensor electrode is preferably maximal so that it is possible in a simple manner to detect that the door handle is being gripped.

Within the scope of the invention, it is fundamentally possible that the door handle covers the grip recess in part in a strip-like manner from only one side, in particular from the upper side. In this case, it is only possible when actuated in the appropriate manner—when viewed in the vehicle vertical direction—to grip the door handle from one side (for example from below). In a preferred embodiment, the door handle is however embodied in such a manner that said door handle spans the grip recess in a bridge-like manner—preferably in the vehicle longitudinal direction. The door handle can be consequently gripped (in accordance with a type of handhold) from two sides. In the case of this embodiment of the door handle, the grip recess is closed in the closed position expediently on two sides (for example from above and below) in each case by a flap.

In an alternative embodiment of the invention, two flaps are arranged in each case on a side of the door handle and in the opened position one of said flaps is pivoted against the wall of the grip recess and the respective other flap is pivoted to the rear side of the door handle. The advantage of this embodiment is in particular that the flaps comprise a smaller flap surface (in comparison to a flap that covers the grip recess alone) and consequently it is possible in the opened position in a particularly simple manner to fit said flaps flush into the wall of the grip recess and into the rear side of the door handle. As a consequence, a virtually smooth and homogenous curve of the wall of the grip recess and in particular of the door handle is achieved in an advantageous manner. As a consequence, it is possible for the vehicle user when gripping the door handle to experience the door handle as virtually smooth, in other words without any protruding edges of the pivoted flap and as a consequence, said door handle can convey a significant operating feeling. In addition, for the case that each flap comprises a sensitive part of the distance sensor, preferably a capacitive sensor electrode, a particularly high level of adjustability of the measuring regions that are allocated in each case to the closed position and the opened position is achieved.

For the case that the door handle system comprises only one sensor electrode, the control and evaluating unit is expediently configured for the purpose of performing a measurement with the aid of this sensor electrode with respect to ground. In other words, the sensor capacitance of the capacitive distance sensor is determined between the sensor electrode and an object that is connected to ground and is arranged in the surrounding area of the sensor electrode. Within the scope of the invention, it is however also feasible that the control and evaluating unit in each case performs a measurement with respect to ground by means of multiple sensor electrodes.

For the case that the door handle system comprises multiple flaps and multiple sensor electrodes that are arranged on these flaps, these sensor electrodes are however interconnected in a preferred embodiment at least in the opened position in each case in pairs as a transmitting electrode and as a receiving electrode. It is possible in a particularly precise manner in comparison to a distance sensor that performs a measurement with respect to ground to set the measuring region of the distance sensor, said measuring region being covered by means of the measuring field between the transmitting- and receiving electrode. The "measuring field" is by way of example an alternating field that is generated by an electrical alternating voltage that is applied to the transmitting- and receiving electrode. The transmitting- and receiving electrode consequently form a sensor capacitor.

In a simple embodiment, the sensor electrodes are also controlled in pairs as sensor- and receiving electrodes in the folded out state, in other words when the flaps are in the closed position. Alternatively, the sensor electrodes are controlled in the closed position so as to perform a measurement with respect to ground.

In particular in the case that the grip recess is covered in the closed position on the two sides of the door handle in each case by means of the two flaps, the sensor electrodes are expediently controlled in the opened position in such a manner that the sensor electrodes that are arranged in each case on a side of the door handle in pairs are used as associated transmitting- and receiving electrodes. As a consequence, it can be precisely detected by means of the respective electrode pairs whether the door handle is being gripped on each side of the door handle in the grip recess. As a consequence, the reliability of detecting that the door handle is being gripped is increased. In particular, it can be detected in a particularly simple manner whether only one foreign body is protruding from only one side of the door handle into the grip recess or that the door handle is being gripped on both sides.

Within the scope of the invention, it is furthermore feasible that in addition to each sensor electrode that is arranged in or on each flap, a sensor electrode ("grip electrode") is arranged in the door handle itself. This or each additional grip electrode cooperates in the opened position with in each case a sensor electrode that is arranged on the flaps in accordance with the transmitter-receiver principle.

In a further optional embodiment, the one or each sensor electrode is segmented in the vehicle longitudinal direction so that it is possible to determine by means of the control and evaluating unit a movement direction of the vehicle user or at least the hand of said vehicle user. In this case, the control and evaluating unit is preferably configured so as in addition to identifying that the vehicle user is approaching the door handle approximately from the front (in other words approximately in the normal direction to the outer side of the door) to also identify a stroke over the one or each flap in the vehicle longitudinal direction and evaluate this stroke as different to the frontal approach. By way of example, the measuring signals that are output by the segments of the sensor electrode are evaluated in dependence upon time. If the changes in the sensor capacitances that are measured by means of the respective segments comprise at least one predetermined temporal offset, the control and evaluating unit concludes that a stroke over the segments has occurred in the longitudinal direction. Otherwise, the control and evaluating unit concludes that a frontal approach has occurred.

In particular, it is provided that a stroke over the one or each flap is to be interpreted in dependence upon the direction as a locking or unlocking command for the vehicle door, in particular for the central locking of the vehicle. In other words, the one or each flap is pivoted into the opened position in the case of a frontal approach to the door handle while the vehicle door is locked if the vehicle user strokes the one or each flap by way of example in the direction of the door lock of the respective vehicle door.

In a further embodiment, the control and evaluating unit is configured for the purpose of activating an illuminating device of the vehicle when detecting that the vehicle user is approaching the one or each flap. An illuminating device of this type is in particular the headlight of the vehicle, in particular circumstances it is the "parking" light or the "low beam" light. Alternatively however, the illuminating device can also be a light source that is arranged on the vehicle door or on the door handle and that when activated illuminates the area of the vehicle door or the grip recess.

In a further embodiment, the control and evaluating unit is configured so as when detecting that the vehicle user is approaching the one or each flap to control a window regulator that is allocated to an adjustable window pane of the vehicle door. This is in particular advantageous in the case of using so-called frameless vehicle doors, by way of example in the case of convertibles or coupes. In this case, namely when opening the vehicle door, the window pane is opened along a small part of its adjustment path with respect to its closed position so that the window pane cannot clamp in its window pane seal that is arranged on the fixed vehicle frame. The control and evaluating unit is expediently configured for the purpose of lowering the window pane of the vehicle door by this predetermined part of the adjustment path in addition to opening the one or each flap. In particular, in the case of a wire-actuated window regulator it can be provided alternatively to control the window regulator merely so as to tension the wire without lowering the window pane.

Other features which are considered as characteristic for the invention are set forth in the appended claims.

Although the invention is illustrated and described herein as embodied in a door handle system for a vehicle door, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
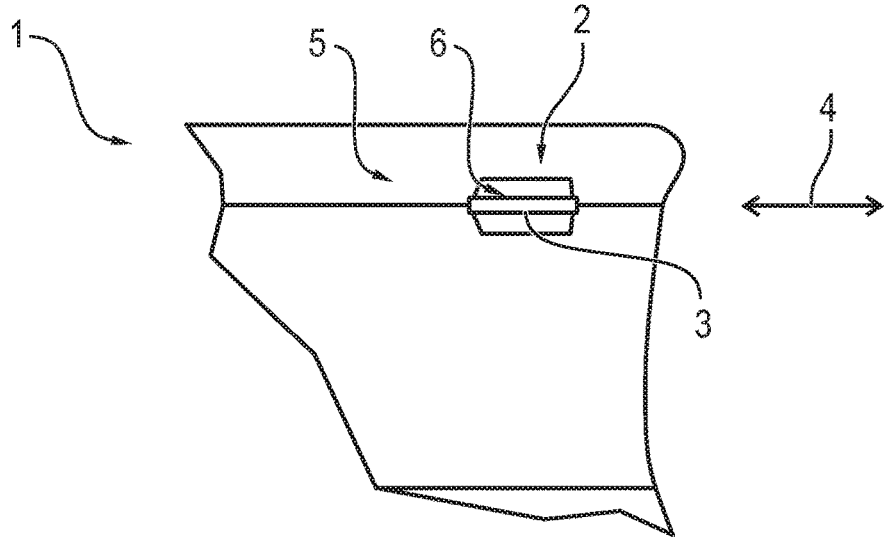
FIG. 1 illustrates in a schematic side view a vehicle door having a door handle module.

Referring now to the figures of the drawing in detail and first, particularly, to FIG. 1 thereof, there is shown an exemplary vehicle door 1 having a door handle system 2 that is arranged thereon. The vehicle door 1 is a frameless door that does not comprise a window frame that delimits the side window of the vehicle with respect to the upper side, the side window being arranged on the vehicle door 1. A vehicle door 1 of this type is used by way of example in the case of convertibles or coupes. The door handle system 2 comprises a door handle 3 that is aligned in the vehicle longitudinal direction 4 and spans a grip recess 6 that is formed in the outer surface 5 of the vehicle door 1.

Figure 2:
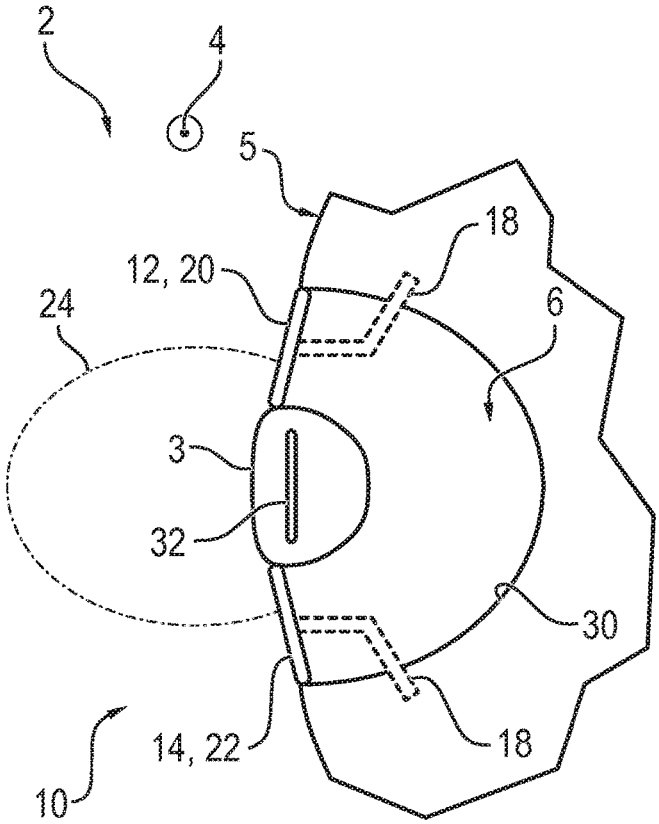
FIG. 2 illustrates in a schematic sectional view the door handle system in a closed position, wherein the one grip recess that is arranged to the rear of the door handle is closed off by means of two flaps with respect to the vehicle outer side.
Figure 3:
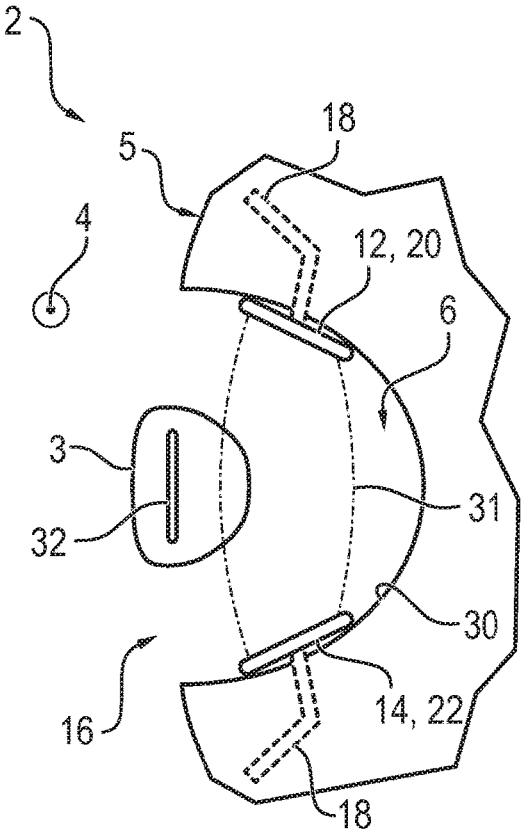
FIG. 3 illustrates in accordance with FIG. 2 the door handle system in an opened position, wherein the flaps are pivoted inwards so as to reveal the grip recess.

In order on the one hand to embody the outer surface 5 of the vehicle door 1 as smooth and therefore to improve the aerodynamic characteristics of the vehicle, the grip recess 6 is closed off with respect to the outer side by means of two flaps 12 and 14 in a closed position 10 that is illustrated in FIG. 2. The flap 12 is arranged above the door handle 3 in relation to the vehicle longitudinal direction 4. The flap 14 is accordingly arranged below the door handle 3. The door handle system 2 furthermore comprises an adjusting device by means of which the flaps 12 and 14 can be automatically adjusted between the closed position 10 that is illustrated in FIG. 2 and an opened position 16 that is illustrated in FIG. 3. In each case, of the adjusting device, only the adjusting lever 18 that is allocated to the flap 12 or 14 is illustrated for purposes of clarity.

In an alternative embodiment, the door handle 3 and also the flaps 12 and 14 can also be arranged vertically on the vehicle door 1. Such an arrangement of the door handle 3 (and the flaps 12 and 14) is in particular provided for the case that the vehicle door 1 is the tailgate of the vehicle.

In addition, the door handle system 2 comprises a capacitive distance sensor and also a control and evaluating unit that is not further illustrated. The control and evaluating unit is configured and provided for the purpose of detecting by means of the capacitive distance sensor the vehicle user approaching the door handle 3 and furthermore to control the adjusting device so as to adjust the flaps 12 and 14 from the closed position 10 into the opened position 16. A capacitive sensor electrode 20 or 22 of the distance sensor is integrated in each case in each flap 12 or 14. The sensor electrodes 20 and 22 cooperate together as a transmitting- and a receiving electrode so that in the closed position 10, a roughly horseshoe-shaped measuring field 24 spreads out towards the outer side of the vehicle door 1 (cf. FIG. 2). The measuring region that is covered by the measuring field 24 is consequently in front of the door handle 3. The measuring field 24 is generated as an electrical alternating field by means of applying an electrical alternating voltage to the sensor electrodes 20 and 22. The sensor electrodes 20 and 22 consequently form a sensor capacitor whose sensor capacitance is detected by the control and evaluating unit.

FIG. 3 illustrates the arrangement of the flaps 12 and 14 in their opened position 16. The flaps 12 and 14 are pivoted onto the inner side of the grip recess 6, in other words against the wall 30 of the grip recess 6. The alternating field (described as recess measuring field 31) that is generated in the opened position 16 between the electrodes 20 and 22 extends in the opened position 16 approximately in a linear manner between the electrodes 20 and 22 and consequently extends in a transverse manner over the interior space (of the grip recess 6) that is delimited by a wall 30 of the grip recess 6. In the opened position 16, in other words the measuring region that is covered by the recess measuring field 31 is located within the grip recess 6 and to the rear of the door handle 3.

A guard electrode 32 is arranged in the door handle 3, said guard electrode being connected to ground potential and configured and provided so as to shield the recess measuring field 31 in the opened position 16 with respect to influences from outside the grip recess 6. The shielding electrode 32 also prevents the presence or a movement of the vehicle user being detected outside the grip recess 6 by the distance sensor (that comprises the sensor electrodes 20 and 22).

The control and evaluating unit of the door handle system 2 is configured so as within the scope of a door opening method when the vehicle door 1 is in the closed state to monitor the immediate surrounding area of the door handle 3 for an approaching person (in short, the vehicle user) by means of the sensor electrodes 20 and 22 arranged in the closed position 10. If the vehicle user is located in the measuring field 24, the sensor capacitance of the sensor electrodes 20 and 22 is altered. This change in the sensor capacitance is registered by means of the control and evaluating unit. In this case, the control and evaluating unit controls the adjusting device so as to open the flaps 12 and 14 into the opened position 16 so that the vehicle user can grip in the grip recess 6 and grip around the door handle 3. In the opened position 16 of the flaps 12 and 14, the control and evaluating unit monitors by means of the recess measuring field 31 whether the hand of the vehicle user is located in the grip recess 6. A change in the sensor capacitance in the opened position 16 by a predetermined value is indicative of the door handle 3 being gripped by means of the hand of the vehicle user. The control and evaluating unit interprets such a change in the sensor capacitance as the vehicle user wishing to open the door and furthermore outputs a door opening signal to the door adjusting motor of the vehicle door 1.

In order to prevent that the flaps 12 and 14 remain open in the case of the door handle 3 not being gripped for an undetermined period of time, the control and evaluating unit is configured so as to monitor the grip recess 6 after opening the flaps 12 and 14 only during a predetermined waiting time, by way of example during 10 seconds, for whether the door handle 3 has been gripped. If the waiting time expires without event, in other words without it being registered that the door handle 3 is being gripped, the control and evaluating unit controls the adjusting device so as to close the flaps 12 and 14.

The case that the sensor capacitance (in the case of the flaps 12 and 14 being in the opened position 16) returns to its idle value (in the absence of the hand in the grip recess 6) is interpreted by the control and evaluating unit as an indication that the vehicle user has let go of the door handle 3. In this case, the control and evaluating unit likewise controls the adjusting device so as to close the flaps 12 and 14.

Figure 4:
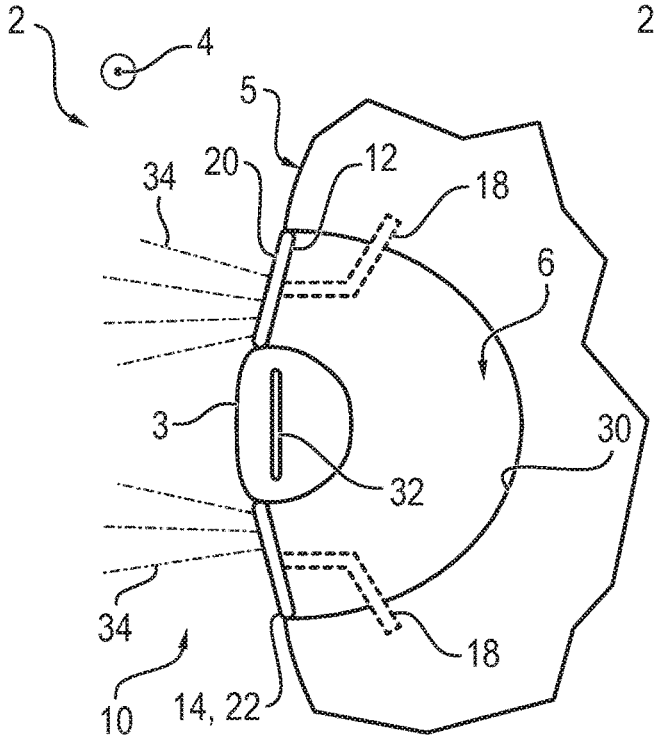
FIGS. 4 to 10 illustrate in a view in accordance with FIG. 2 various exemplary embodiments of the door handle system in the closed position or in the opened position.
Figure 5:
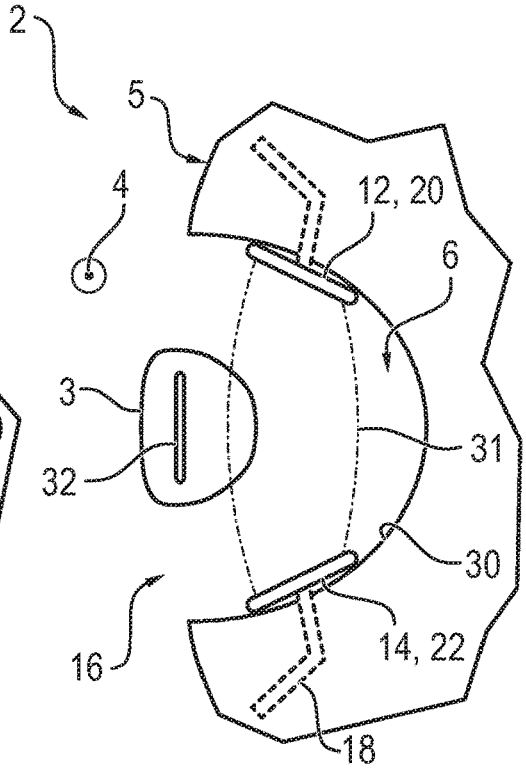

FIG. 4 and FIG. 5 illustrate an alternative exemplary embodiment of the door handle system 2, wherein the sensor electrodes 20 and 22 are controlled in the closed position 10 in such a manner that a distance measurement can be performed with respect to ground by means of each sensor electrode 20 or 22. This is indicated in FIG. 4 in an exemplary manner by means in each case of field lines 34 that extend from each sensor electrode 20 or 22 and are indicated by way of example in a linear manner. In this measuring mode, each sensor electrode 20 or 22 consequently forms a sensor capacitor with the nearest grounded object that is arranged in the surrounding area of the vehicle. In the opened position 16, the sensor electrodes 20 and 22 are in turn controlled as transmitting- and receiving electrodes so that the distance sensor can be used according to the exemplary embodiment in accordance with FIGS. 2 and 3 (cf FIG. 5).

Figure 6:
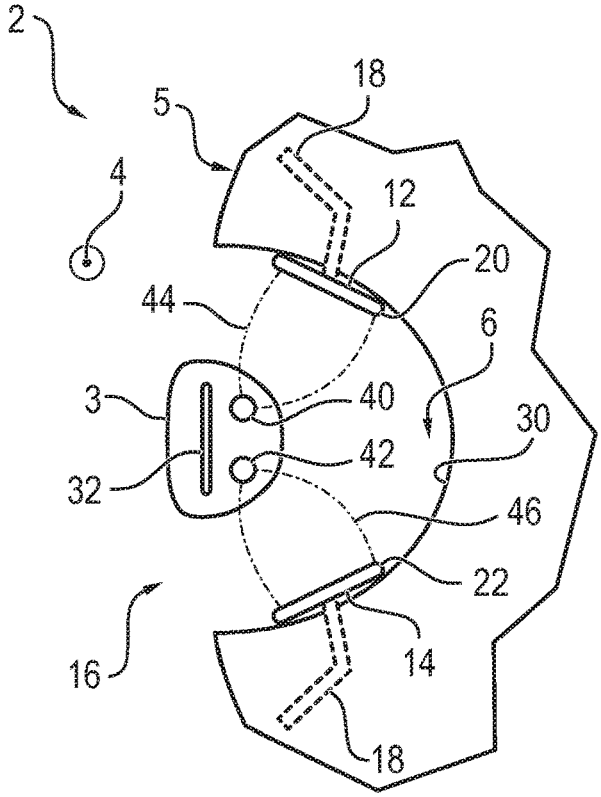

In accordance with a further alternative exemplary embodiment that is illustrated in FIG. 6, in addition two further sensor electrodes (described as "grip electrodes 40 and 42") are arranged in the door handle 3. The distance sensor in this exemplary embodiment is configured so as in the opened position 16 to control the sensor electrode 20 and the grip electrode 40 and also the sensor electrode 22 and the grip electrode 42 in each case in pairs as transmitting- and receiving electrodes. As a consequence, in the opened position 16, the sensor electrode 20 and the grip electrode 40 and also the sensor electrode 22 and the grip electrode 42 form in each case a sensor capacitor having a respective allocated recess measuring field 44 or 46. It is possible by means of controlling the sensor electrodes 20 and 40 or 22 and 42 to separately detect that the grip recess 6 is being gripped on each side of the door handle 3 by means of the respective allocated electrode pair.

Figure 7:
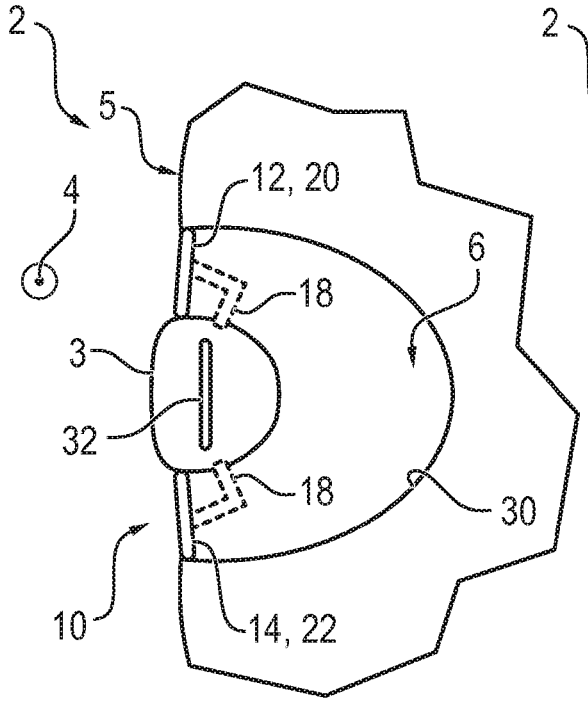
Figure 8:
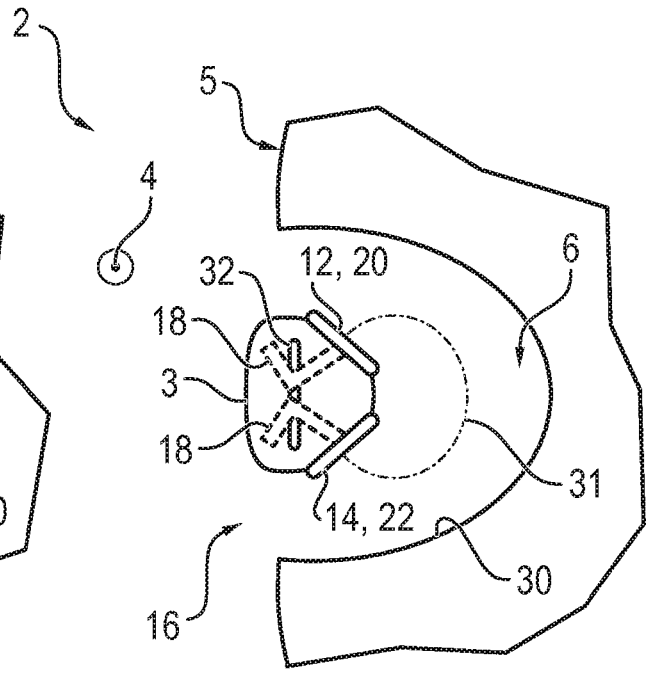

In a further exemplary embodiment in accordance with FIGS. 7 and 8, the flaps 12 and 14 are hinged on the door handle 3 in such a manner that they can pivot so that the flaps 12 and 14 are folded in the opened position 16 onto the rear side of the door handle 3. The flaps 12 and 14 form a part of the surface of the door handle 3, said part of the surface of the door handle facing the grip recess 6. The recess measuring field 31 of the sensor electrodes 20 and 22 extends in the illustrated exemplary embodiment in the opened position 16 approximately in a U-shape and thereby approximately parallel to the wall 30 of the grip recess 6.

Figure 9:
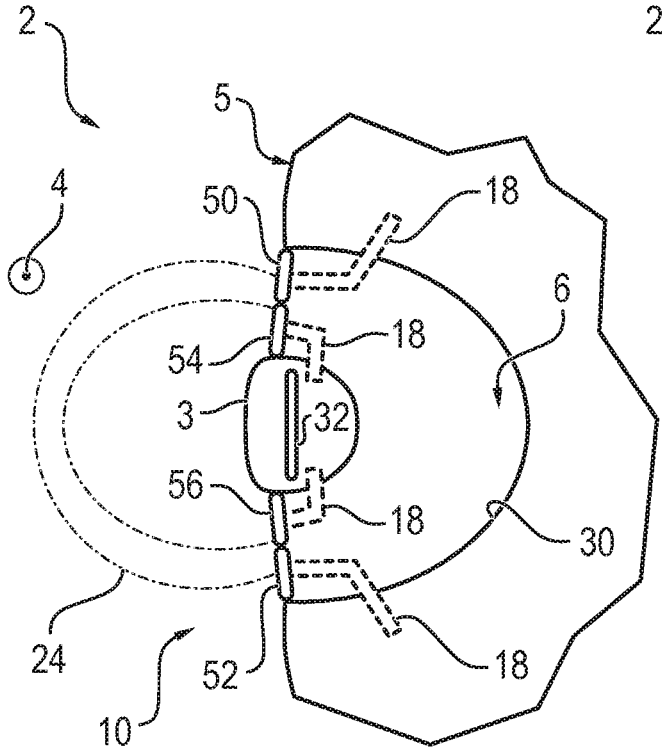
Figure 10:
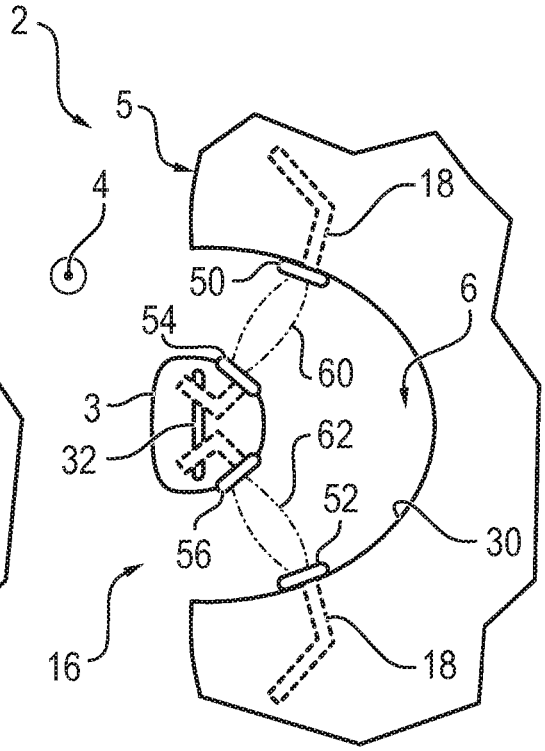

In a further alternative exemplary embodiment in accordance with FIGS. 9 and 10, the grip recess 6 is closed in the closed position 10 on the two sides of the door handle 3 by means of in each case two flaps. In each case, one of the flaps (hereinunder described as the upper recess flap 50 and the lower recess flap 52) can be pivoted onto the grip recess 6 so that the upper and the lower recess flap 50 or 52 in the opened position 16 lie against the wall 30 of the grip recess 6. The two other flaps are described hereinunder as the upper grip flap 54 and lower grip flap 56 and are pivoted in the opened position 16 onto the rear side of the door handle 3 (cf. FIG. 10). A sensor electrode of the distance sensor is arranged in each case on the recess flaps 50 and 52 and the grip flaps 54 and 56.

As is illustrated in FIG. 9, the sensor electrodes are controlled in the closed position 10 in such a manner that the sensor electrodes of the upper recess flap 50 and the upper grip flap 54 form a common upper electrode. The sensor electrodes of the lower recess flap 52 and the lower grip flap 56 are controlled in a similar manner and consequently form a common lower electrode. The upper electrode and the lower electrode are controlled in a manner that can be compared to the exemplary embodiment in accordance with FIG. 2 as a transmitting- and receiving electrode and form the horseshoe-shaped measuring field 24 with respect to the outer side of the door handle 3.

In the opened position 16 (cf. FIG. 10), the sensor electrodes of the upper recess flap 50 and the upper grip flap 54 and also the sensor electrodes of the lower recess flap 52 and the lower grip flap 56 in contrast are controlled in pairs as transmitting- and receiving electrodes. Consequently, a measuring field 60 is formed between the sensor electrodes of the upper recess flap 50 and the upper grip flap 54 and a measuring field 62 is formed between the sensor electrodes of the lower recess flap 52 and the lower grip flap 56. The control and evaluating unit can be configured in a manner comparable to the exemplary embodiment in accordance with FIG. 6 so as to detect that the door handle 3 is being gripped.

In an alternative (not further illustrated) exemplary embodiment, the control and evaluating unit is configured so as in the opened position 16 to control the sensor electrodes of the recess- and grip flaps 50 to 56 in an alternating manner. In a first step, the sensor electrodes are controlled in accordance with the exemplary embodiment in accordance with FIG. 10. In a second step, in contrast the sensor electrodes of the recess flaps 50 and 52 are switched off. The sensor electrodes of the grip flaps 54 and 56 are then controlled as transmitting- and receiving electrodes. This second control corresponds essentially to the exemplary embodiment in accordance with FIG. 8. It is possible by means of controlling the sensor electrodes in an alternating manner to detect in a particularly precise manner that the door handle 3 is being gripped on all sides and the reliability of the door handle system 1 is thereby increased.

The subject matter of the invention is not limited to the above-described exemplary embodiments. On the contrary, further exemplary embodiments of the invention can be derived by the person skilled in the art from the above description. In particular, the individual features of the invention that are described with reference to the various exemplary embodiments and their embodiment variants can also be combined with one another in other ways.

The following is a summary list of reference numerals and the corresponding structure used in the above description of the invention:

1 Vehicle door
2 Door handle system
3 Door handle
4 Vehicle longitudinal direction
5 Outer surface
6 Grip recess
10 Closed position
12 Flap
14 Flap
16 Opened position
18 Adjusting lever
20 Sensor electrode
22 Sensor electrode
24 Measuring field
30 Wall
31 Recess measuring field
32 Guard electrode
34 Field line
40 Grip electrode
42 Grip electrode
44 Recess measuring field
46 Recess measuring field
50 Upper recess flap
52 Lower recess flap
54 Upper grip flap
56 Lower grip flap
60 Measuring field
62 Measuring field

The invention claimed is:

1. A door handle system for a vehicle door of a vehicle, the door handle system comprising:

a door handle having a rear side;

at least two flaps for reversibly closing off a grip recess formed in the vehicle door and set back with respect to an outer surface of the vehicle door relative to the rear side of said door handle, said door handle spans said grip recess, said grip recess is reversibly closed off by said at least two flaps when said at least two flaps are in a closed position, said at least two flaps being arranged on two sides of said door handle;

an adjusting device configured to pivot said at least two flaps between the closed position that reversibly closes off said grip recess and an opened position that reveals said grip recess;

a distance sensor, at least in part, disposed on said at least two flaps; and a control and evaluating unit configured:

with reference to a first measuring signal output by said distance sensor when said at least two flaps are in the closed position, to conclude that a vehicle user is approaching said at least two flaps;

to control said adjusting device so as to pivot said at least two flaps into the opened position when detecting that the vehicle user is approaching said at least two flaps; and to determine with reference to a second measuring signal output by said distance sensor when said at least two flaps are in the opened position whether said door handle is being gripped by the vehicle user.

2. The door handle system according to claim 1, wherein said distance sensor is a capacitive distance sensor, and said at least two flaps support a respective sensor electrode of said distance sensor.

3. The door handle system according to claim 2, wherein said control and evaluating unit is configured to control said at least two sensor electrodes of said distance sensor, at least in the opened position, in pairs as a transmitter electrode and as a receiving electrode.

4. The door handle system according to claim 1, wherein said distance sensor is embodied as a capacitive distance sensor, and wherein said at least two flaps form a respective sensor electrode of said capacitive distance sensor.

5. The door handle system according to claim 1, wherein said at least two flaps are pivoted into the opened position against a wall of said grip recess.

6. The door handle system according to claim 1, wherein said at least two flaps are pivoted into the opened position onto said rear side of said door handle.

7. The door handle system according to claim 1, wherein said at least two flaps each are disposed on one of the two sides of said door handle, wherein in the opened position, one of said at least two flaps is pivoted against a wall of said grip recess and another one of said at least two flaps is pivoted onto said rear side of said door handle.

8. The door handle system according to claim 1, wherein said control and evaluating unit is configured so as to activate an illuminating device of the vehicle when detecting that the vehicle user is approaching said at least two flaps.

9. The door handle system according to claim 1, wherein said control and evaluating unit is configured to control a window lifter associated with a window pane of the vehicle door when detecting that the vehicle user is approaching said at least two flaps.

* * * * *